US008757382B1

(12) United States Patent
Crawford

(10) Patent No.: US 8,757,382 B1
(45) Date of Patent: Jun. 24, 2014

(54) CONTAINER APPARATUS WITH SINGLE-PILL DISPENSING AND RELATED METHOD

(71) Applicant: Robert J. Crawford, Apple Valley, MN (US)

(72) Inventor: Robert J. Crawford, Apple Valley, MN (US)

( * ) Notice: Subject to any disclaimer, the term of this patent is extended or adjusted under 35 U.S.C. 154(b) by 0 days.

(21) Appl. No.: 13/923,172

(22) Filed: Jun. 20, 2013

Related U.S. Application Data

(63) Continuation of application No. 12/917,725, filed on Nov. 2, 2010, now Pat. No. 8,469,194.

(60) Provisional application No. 61/368,995, filed on Jul. 29, 2010.

(51) Int. Cl.
*B65D 83/04* (2006.01)
*B65D 85/42* (2006.01)

(52) U.S. Cl.
USPC ..... 206/540; 206/534.2; 206/810; 220/324; 220/835; 220/840; 220/282; 220/315; 220/810; 221/306

(58) Field of Classification Search
CPC ..... B65D 83/04; B65D 85/42
USPC ..... 206/810, 540, 534.2; 220/282, 324, 220/825, 840, 315, 810; 221/306
See application file for complete search history.

(56) References Cited

U.S. PATENT DOCUMENTS 1,369,819 A * 3/1921 Krause ..... 220/282
2,026,463 A * 12/1935 Driess ..... 220/282
2,219,487 A * 10/1940 Nyden ..... 206/534.2
2,307,087 A * 1/1943 White ..... 220/283
2,492,864 A * 12/1949 Hermani ..... 206/540
3,874,564 A 4/1975 Huneke
3,889,847 A 6/1975 Uroshevich et al.
3,894,654 A * 7/1975 Frankenberg ..... 220/283
3,998,356 A 12/1976 Christensen
4,047,635 A 9/1977 Bennett, Jr.
4,078,661 A 3/1978 Thomas
4,288,006 A 9/1981 Clover, Jr.
4,460,106 A 7/1984 Moulding, Jr. et al.
4,530,447 A 7/1985 Greenspan
4,541,541 A 9/1985 Hickman et al.
4,572,376 A 2/1986 Wrennall
4,640,560 A 2/1987 Blum (Continued)

FOREIGN PATENT DOCUMENTS

WO 97/20537 A1 6/1997

*Primary Examiner* — Gene O. Crawford
*Assistant Examiner* — Rakesh Kumar
(74) *Attorney, Agent, or Firm* — Crawford Maunu PLLC

(57) ABSTRACT

Aspects of the disclosure involve a pill-filtering article that is located and secured inside a pill container. According to one example embodiment, an assembly of articles distributes one pill at a time in the form of a single-pill dispensing apparatus that includes a pill-storage container and such a pill-filtering article. The container has an inner wall, an upper portion with a rim region where a cap may be secured, and a lower portion for containing pills. The pill-filtering article has a size and a shape that facilitates securing the article inside the pill-storage container near the inner wall, above the lower portion, and below the upper rim region, and also configured with a plurality of channel-defining regions including a first channel-defining region through which one-pill at a time passes and including a second channel-defining region through which one pill at a time passes.

18 Claims, 5 Drawing Sheets

(56) References Cited

U.S. PATENT DOCUMENTS

| | | | | |
|---|---|---|---|---|
| 4,685,271 | A | 8/1987 | Ringer et al. | |
| 4,807,778 | A * | 2/1989 | Lo | 220/282 |
| 5,269,432 | A | 12/1993 | Beckertgis | |
| 5,407,107 | A | 4/1995 | Smith | |
| 5,549,217 | A | 8/1996 | Benarrouch | |
| 6,267,265 | B1 | 7/2001 | Issa | |
| 6,860,403 | B1 | 3/2005 | Mehrens et al. | |
| 7,147,130 | B1 | 12/2006 | Clark et al. | |
| 7,225,597 | B1 | 6/2007 | Knoth | |
| 7,240,795 | B2 | 7/2007 | Lee | |
| 7,377,401 | B2 | 5/2008 | Humphrey | |
| 7,426,814 | B2 | 9/2008 | Knoth | |
| 7,938,266 | B2 * | 5/2011 | Cross | 206/540 |
| 7,938,267 | B2 * | 5/2011 | Cross | 206/540 |
| 7,939,819 | B2 * | 5/2011 | Aoki | 257/40 |
| 7,946,250 | B2 | 5/2011 | Holms et al. | |
| 7,967,160 | B2 | 6/2011 | Rault et al. | |
| 2007/0007301 | A1 | 1/2007 | Kaplan et al. | |
| 2009/0194556 | A1 | 8/2009 | Klein et al. | |

* cited by examiner

CONTAINER APPARATUS WITH SINGLE-PILL DISPENSING AND RELATED METHOD

RELATED PATENT DOCUMENT

This patent document is a continuation under 35 U.S.C. §120 of U.S. patent application Ser. No. 12/917,725 filed on Nov. 2, 2010 (U.S. Pat. No. 8,469,194), which claims benefit under 35 U.S.C. §119 to U.S. Provisional Patent Application Ser. No. 61/368,995, entitled "Container with Single-Pill Dispenser and Related Methods" and filed on Jul. 29, 2010; each of these patent documents is fully incorporated herein by reference.

FIELD

The present disclosure relates generally to pill-like containers, methods for manufacturing and assembling such containers, and methods for filling such containers and for dispensing pills from pill bottles.

BACKGROUND

Delivery of a pill, such as a capsule, a medicinal pill, a tablet and a caplet, has traditionally been accomplished via simple plastic containers with safety-locking caps. In the case of medicinal pills, for example, a pharmacist stores the prescribed pills in the container, prints the label and places it on the container and then secures the container using the safety-locking cap. A significant problem with this form of pill delivery is well-recognized when one attempts to access quickly and efficiently, a single pill from the container. With the cap removed and the container tipped, rather than dispensing a single pill, this pill-delivery approach results in the too-common problem of a multitude of pills being dispensed, thereby requiring all but the selected one(s) to be picked up and placed back into the container.

Various mechanical devices have been engineered in attempts to isolate a single pill during this dispensing process and thereby provide the consumer access more conveniently. For example, various types of lids have been developed for channeling the pills upon certain actuation of mechanical articles that involve movement of the lid or parts within the container. In many of these constructions, the rotation of the container's cap or other internal part allows a pill to fall by gravity into the consumer's hand. Such mechanisms are complex, typically involving a series of chambers and with a covering flange that moves between open and closed positions. Further, these mechanisms are problematic in that capsule delivery is limited by manufacture to only one capsule type of a single size and in that the economic considerations of the complex mechanisms limit wide-spread commercial implementations.

For an industry attempting to accommodate many dexterity-disadvantaged patients in depressed economic conditions, whether the patient's hands are arthritic or fatigued, there remains a significant need for single-pill dispensing methods and apparatuses that are simple and inexpensive to manufacture and that can realize widespread use by not burdening or challenging the consumers' efforts to access a single pill at a time.

The above issues as well as others have presented challenges to the various trade channels which include (without limitation) pill consumers, medicinal professionals (e.g., medicine-pill-manufacturer or pharmacy agent) involved in filling pill containers, and manufacturers of containers for pills.

SUMMARY

The present disclosure is directed to overcoming the above-mentioned challenges and others related to the types of pill-dispensing devices and methods (including use, assembly and manufacture) discussed above and elsewhere. The present disclosure is exemplified in a number of implementations and applications, some of which are summarized below.

According to an example embodiment, the present disclosure is directed to a single-pill dispensing apparatus and methods that involve a pill-storage container and a pill-filtering article. In certain methods of manufacture, a pill-storage container and a pill-filtering article are manufactured separately or together, for assembly and later consumer use (patient-type and otherwise). In many of the example embodiments discussed herein, the pill-storage container has an inner wall, an upper portion with a rim region at which a cap may be secured to the pill-storage container, and a lower portion configured for containing pills. The pill-filtering article is configured with a size and a shape that facilitate securing the article inside the pill-storage container near the inner wall, above the lower portion, and below the upper rim region, and also configured with different channel-defining regions including regions which are to be modified to form an opening through which one pill at a time passes. Each region is for a different type of pill, such as a type of pill that is differentiated by its different size and/or shape. In this regard, each of the plurality of channel-defining regions is respectively configured and arranged to facilitate a modification that results in formation of an aperture near a boundary of the channel-defining region for passing one pill at a time, and to pass pills that are of different types in terms of at least one of size and shape. When only one of the plurality of channel-defining regions is modified, the pill-filtering article permits only one pill at a time to pass, through the aperture ensuing from the modification, from the lower portion of the container to the upper portion of the container.

The above summary of the present disclosure is not intended to describe each illustrated embodiment or every implementation of the present disclosure. The figures and detailed description that follow more particularly exemplify these embodiments.

BRIEF DESCRIPTION OF THE FIGURES

The invention may be more completely understood in consideration of the detailed description of various embodiments of the disclosure that follows in connection with the accompanying drawings, in which.

Figure 1A:
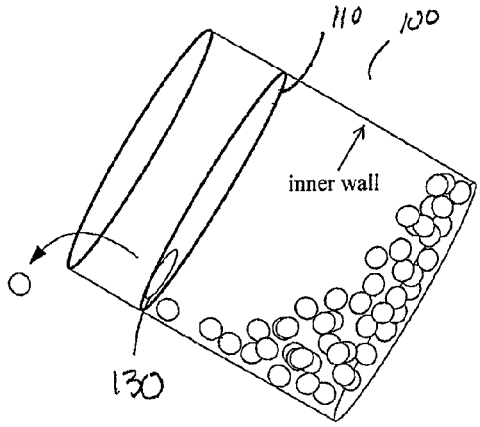
FIGS. 1*a* and 1*b* are diagrams of a single-pill dispensing apparatus, according to an example embodiment of the present disclosure.

While the illustrated and discussed aspects in the disclosure are amenable to various modifications and alternative forms, various embodiments have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the invention.

DETAILED DESCRIPTION

The present invention is believed to be applicable to a variety of pill-related environments and channels of trade where it is desirable to facilitate, at some point in the chain of trade, dispensing of one-pill at a time from a container. Aspects of the invention have been found to be particularly suited for distributing medicinal pills through a medicinal professional such as a pharmacist or a pill manufacturer. While the present invention is not necessarily limited to such applications, various aspects of the invention may be appreciated through a discussion of examples using this context.

According to certain example embodiments, the present invention is directed to a single-pill dispensing apparatus that includes a pill-storage container and a pill-filtering article. The pill-storage container has an inner wall, an upper portion with a rim region at which a cap may be secured to the pill-storage container, and a lower portion configured for containing pills. The pill-filtering article is configured with a size and a shape that facilitate securing the article inside the pill-storage container near the inner wall, above the lower portion, and below the upper rim region, and also configured with a plurality of channel-defining regions including a first channel-defining region through which one pill at a time passes and including a second channel-defining region through which one pill at a time passes. Each of the plurality of channel-defining regions is respectively configured and arranged to facilitate a modification that results in formation of an aperture near a boundary of the channel-defining region for passing one pill at a time, and to pass pills that are of different types in terms of at least one of size and shape. In this regard, when only one of the plurality of channel-defining regions is modified, the pill-filtering article permits only one pill at a time to pass, through the aperture ensuing from the modification, from the lower portion of the container to the upper portion of the container.

Figure 5:
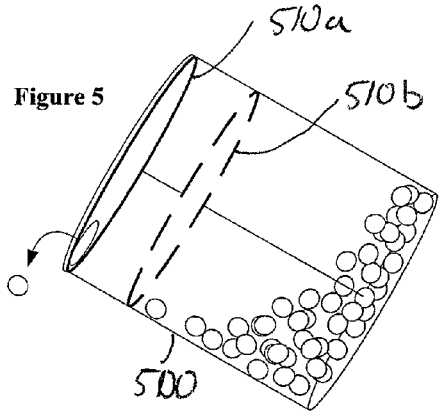
FIG. 5 is a diagram representing yet additional examples of embodiments directed to pill-filtering articles, also according to the present disclosure.

As general illustrations of the above and various other embodiments consistent with the present disclosure, FIGS. 1*a* and 5 show examples of such single-pill dispensing apparatuses. Each of FIGS. 1*a* and 5 show a pill-storage container 100/500 and a pill-filtering article 110/510 (510*a* or 510*b*) dispensing a pill through a selected one of the pill-specific aperture/channel-defining regions of the pill-filtering article 110/510. In connection with the following discussion of other important aspects, FIGS. 1*a* and 5 may be generally referenced to facilitate a complete understanding of the disclosure.

In certain more specific embodiments, the apparatus is implemented wherein the plurality of channel-defining regions includes respectively-sized regions for passing pills, one at a time, that are of different types in terms of size and/or shape.

In another more specific embodiment, the pill-filtering article is configured and arranged with a thickness that defines an elongated inner wall of at least one of the plurality of channel-defining regions.

In another more specific embodiment, the aperture is formed by pushing or punching out one of the channel-defining regions.

In yet further more specific embodiments, at least one of the channel-defining regions is located proximal a portion of the inner wall, and located distal to a center portion of the pill-filtering article, and wherein the pill-filtering article and said at least one of the channel-defining regions is configured and arranged to provide a physically-retarding impediment to multiple pills sliding along the inner wall as pills move away from the lower portion of the container.

Another example aspect of the disclosure is directed to a method wherein a single pill is dispensed one at a time from a pill-storage container that has an inner wall, an upper portion with a rim region at which a cap may be secured to the pill-storage container, and a lower portion. The lower portion is configured for containing pills at single-pill dispensing apparatus and a pill-filtering article is secured in the pill-storage container for filtering all but one pill at a time. The method includes storing pills of at least one type in the lower portion of the pill-storage container; securing the pill-filtering article in the pill-storage container for location above the pills in the lower portion and below the upper rim region, the pill-filtering article being configured with a size and a shape that fits the article inside the pill-storage container near the inner wall and with a plurality of channel-defining regions including a first channel-defining region through which one-pill at a time passes. Also, a second channel-defining region is included through which one pill at a time passes, wherein each of the plurality of channel-defining regions is respectively configured and arranged to facilitate a modification that results in formation of an aperture near a boundary of the channel-defining region for passing one pill at a time. When only one of the channel-defining regions is modified, the pill-filtering article permits only one pill at a time to pass, through the aperture ensuing from the modification, from the lower portion of the container to the upper portion of the container.

In more specific example embodiments, the above method further includes one or more of the following aspects: pushing or punching out one of the channel-defining regions after the step of storing pills of at least one type in the lower portion of the pill-storage container; the step of storing pills is performed in a pharmacy and wherein the step of pushing or punching out one of the channel-defining regions is performed after the step of storing pills; the step of storing pills is performed by a medicinal professional, such as by a medicine-pill-manufacturer or pharmacy agent; the step of readying the pills for a patient is performed by closing and securing the container using the cap, and wherein the step of pushing or punching out one of the channel-defining regions is performed before the step of storing pills of at least one type in the lower portion of the pill-storage container, or by a medicinal professional before the step of readying the pills for a patient.

Referring back to the drawings, FIG. 1*a* illustrates in a general form an example of a pill-storage container having secured therein along an inner wall of the container 100, the pill-filtering article 110 secured along its outer periphery or edge to the inner wall. In a typical implementation employing currently-available manufacturing resources, the pill-storage container and container cap are made using conventional materials such as clear or semi-clear plastic for the container and a hard plastic material for the cap. In one specific example embodiment, the pill-filtering article 110 is composed of a softer plastic that would permit for and facilitate removing a section of the material for forming a pill-passing aperture 130 or (aperture-defining) channel. The aperture can be formed by tearing or destroying the material along a boundary, such as a perforated, partially-torn section, or otherwise material-stressed area. Alternatively, the aperture 130 is formed by using a sharp punch tool on the material, with or without a pre-formed boundary, at the time the pill type is selected for insertion into the container.

Figure 1B:
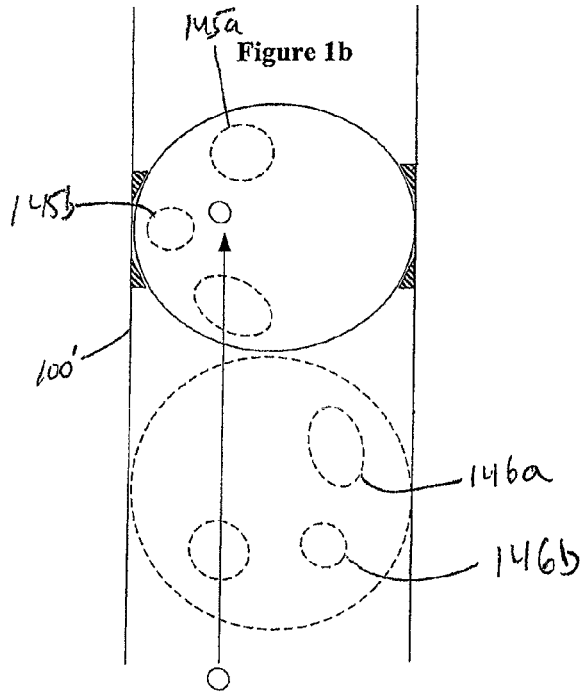

As shown in exploded form in FIG. 1*b*, outer periphery or edges of such a pill-filtering article 130 are treated, e.g., heat-softened for pressure fitting or with an adhesive, for securing at the inner wall within the container 100'. Alternatively, the edges of the pill-filtering article are constructed and adapted in collaboration with the container such that a protrusion or protrusions along the inner wall permit for the article to be secured at such protrusion(s). Examples of such protrusions are shown and depicted as shoulders 145*a-b* and 146*a-b* which may be formed as part of or secured to the inner wall of the container 100'.

FIG. 1*b* illustrates two such pill-filtering articles 110 which are configured and arranged in the container 100' in a cooperative manner so that respectively aligned channel-defining regions of each article 100 and 100' permit a pill to pass through the smaller of two apertures defined by the aligned regions. By rotating one such article relative to the other, the align regions are used to form the aperture, and the other regions are arranged to block the channel-defining regions of the other (mating) article. This configuration is advantageous as it permits for adjustment of shapes of sizes of apertures as a function of how the alignment is implemented. The mating articles can be secured to one another and/or to the inner wall of the container by friction or by another more permanent manner such as via an adhesive.

Figure 2:
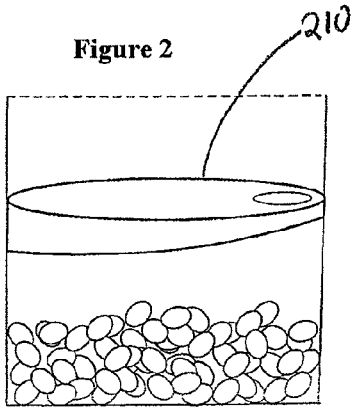
FIG. 2 is a diagram showing a pill-filtering article, according to another example aspect of the present disclosure.

FIG. 2 illustrates another general form of a pill-filtering article 210, representing numerous embodiments in accordance with the present disclosure. Consistent herewith, the pill-filtering article is formed in a wedge shape that is useful for one of a number of different purposes. The wedge shape can be tailored so that the side with the thicker edge has an adhesive for securing to one part of the inner wall of the container and/or so that the (opposing) side with the thinner edge can be more readily pushed into place by pressure for securing the article to another (opposing) part of the container's inner wall. The wedge shape can also be tailored and used on its bottom side to guide pills on the bottom (pill-storing) side of the container toward the channel region where the aperture guides the pills for dispensing. The wedge shape can also be tailored and used on its top side to guide pills back toward the channel region where the aperture would guide any external (e.g., inadvertently dispensed) pills back into the container for storage. In yet other related embodiments, two similarly-constructed pill-filtering articles are configured and arranged to face one another effectively to form a single article with or without the above-discussed wedge effects as may be preferred for a given situation.

Figure 3:
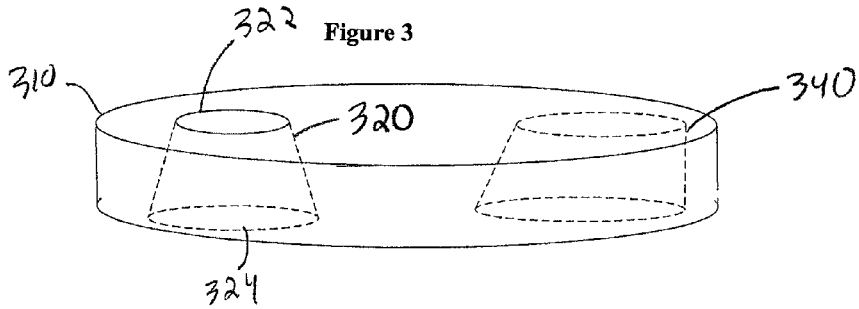
FIG. 3 is a diagram showing another example embodiment of a pill-filtering article, according to another example aspect of the present disclosure.

FIG. 3 illustrates another general form of a pill-filtering article 310 in which at least one channel 320 or aperture is defined by two differently-sized openings 322 and 324. Another optional channel 340 may be similarly constructed with different angles to affect different preferences. As shown, the top side of the article has an aperture with an opening or diameter that is smaller than that of the bottom side. In this configuration, pills quickly accumulate at the bottom side of the aperture for passage of one pill at a time through the top side.

FIGS. 4*a*, 4*b*, 4*c* and 4*d* (collectively FIG. 4) illustrate yet other embodiments of a pill-filtering article 410 for a single-pill dispensing apparatus 400. In connection with this illustration, the pill-filtering article 410 includes a first portion 410*a* with material that defines the channel-defining regions and is used to form (aligned) apertures 430*a* and 430*b*, and a second portion 410*b* that is configured and arranged relative to the first portion to act as at least one of a block over one of the channel-defining regions of the first portion and a wedge to facilitate tilting of pills between a location along a surface of the pill-filtering article and an aperture of the pill-filtering article.

As with FIGS. 2 (and 1*b*), each portion can be wedge-shaped for at least one advantage discussed above. Associated with the embodiments of FIGS. 1*b*, 2 and 4, the portions of the articles can be manufactured identically (e.g., using the same mold(s)) and then placed and oriented using the wedges and holes and sides of each portion or piece to align for the appropriate pill size and wedge-related advantage as might be preferred per application.

Figure 4A:
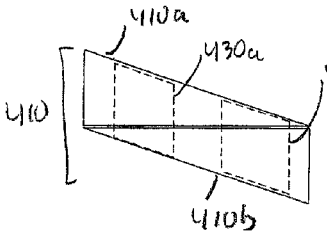
FIG. 4 (including FIGS. 4*a*, 4*b*, 4*c* and 4*d*) shows yet other examples of pill-filtering articles and apparatuses, according to other example aspects of the present disclosure.
Figure 4B:
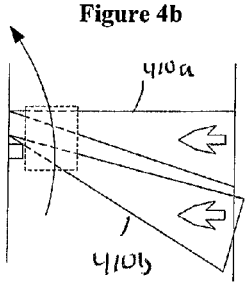
Figure 4C:
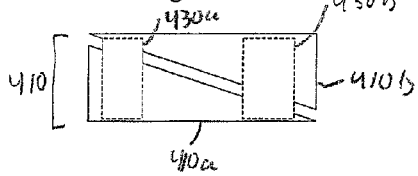
Figure 4D:
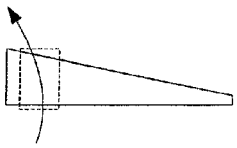

In FIG. 4*b*, the directional arrows depict the pressure fitting of oversized pill-filtering portions 410*a* and 410*b* to facilitate securing them within the container, "oversized" being relative to the inner diameter of the container 400.

FIG. 5 illustrates another configuration in which a pill-filtering article 510*a* is used near (at the rim or within the thickness of a pill) the container's rim. The pills are first placed inside the container 500 and then the pill-filtering article 510*a* is used as a safety/tamper-indicating seal and to secure the pills in the container. Such a breakable pill-filtering article can be made of paper or foil, with adhesive attributes being conventional for such safety/tamper-indicating seals. After being purchased, the consumer breaks the channel region for access to the pills, one pill at a time (or breaks the entire seal if so desired).

A pill-filtering article 510*b* can be used further below the container's rim, for example, a distance equal to the thickness of several pills, so as to permit a pill-holding reservoir above pill-filtering article 510*b* where the pill can be isolated and readily retrieved by the consumer. Pill-filtering article 510*b* can also be used together with pill-filtering article 510*a*, wherein one or both serve as safety/tamper-indicating seals and one or both serve to control dispensing one pill at a time.

Figure 6:
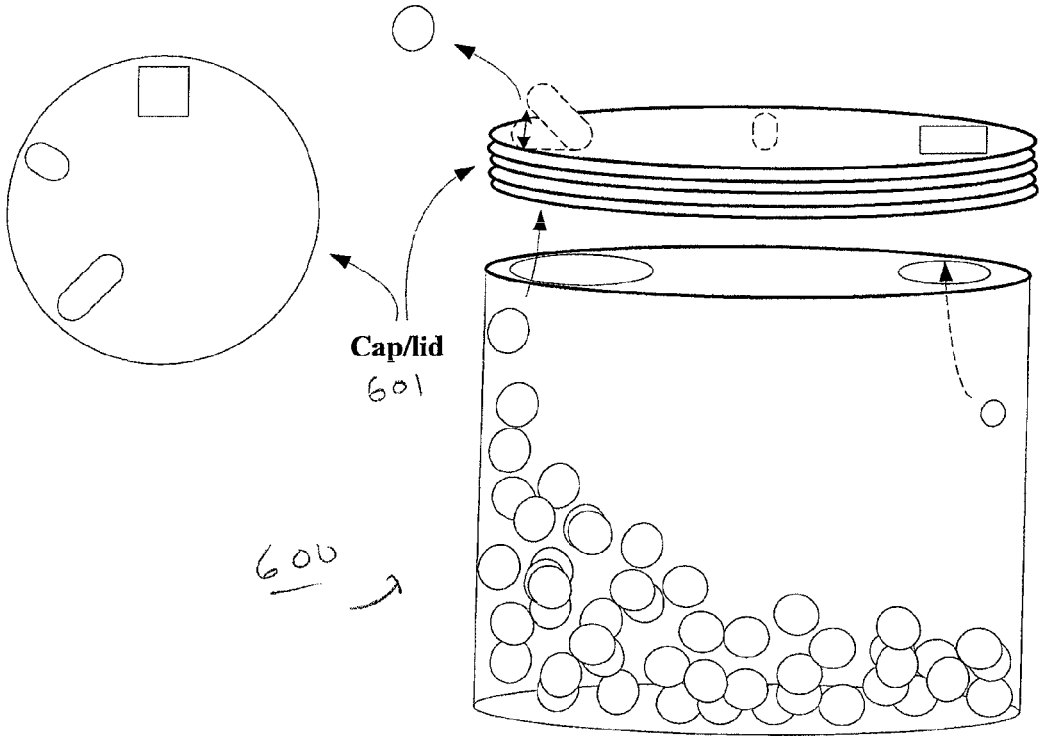
FIG. 6 is a diagram representing further examples of embodiments directed to pill-filtering articles, also according to the present disclosure.
Figure 7:
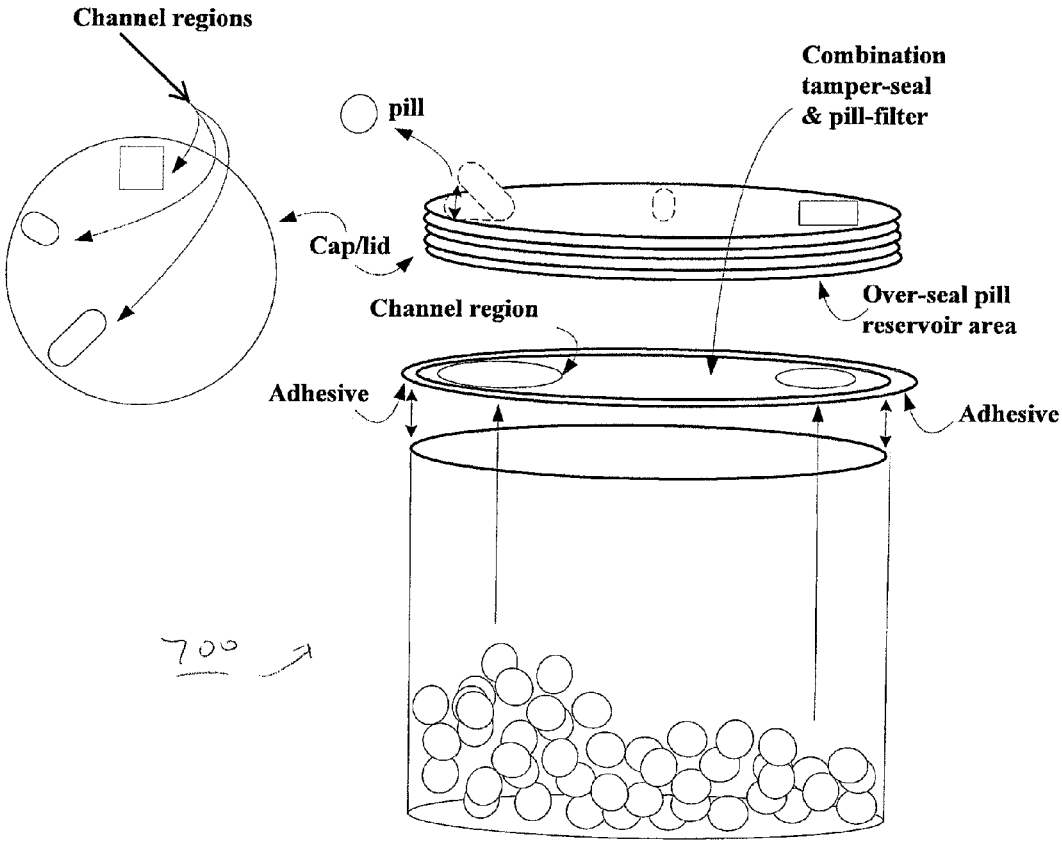
FIG. 7 is another diagram representing yet additional examples of embodiments directed to pill-filtering articles, also according to the present disclosure.
Figure 8:
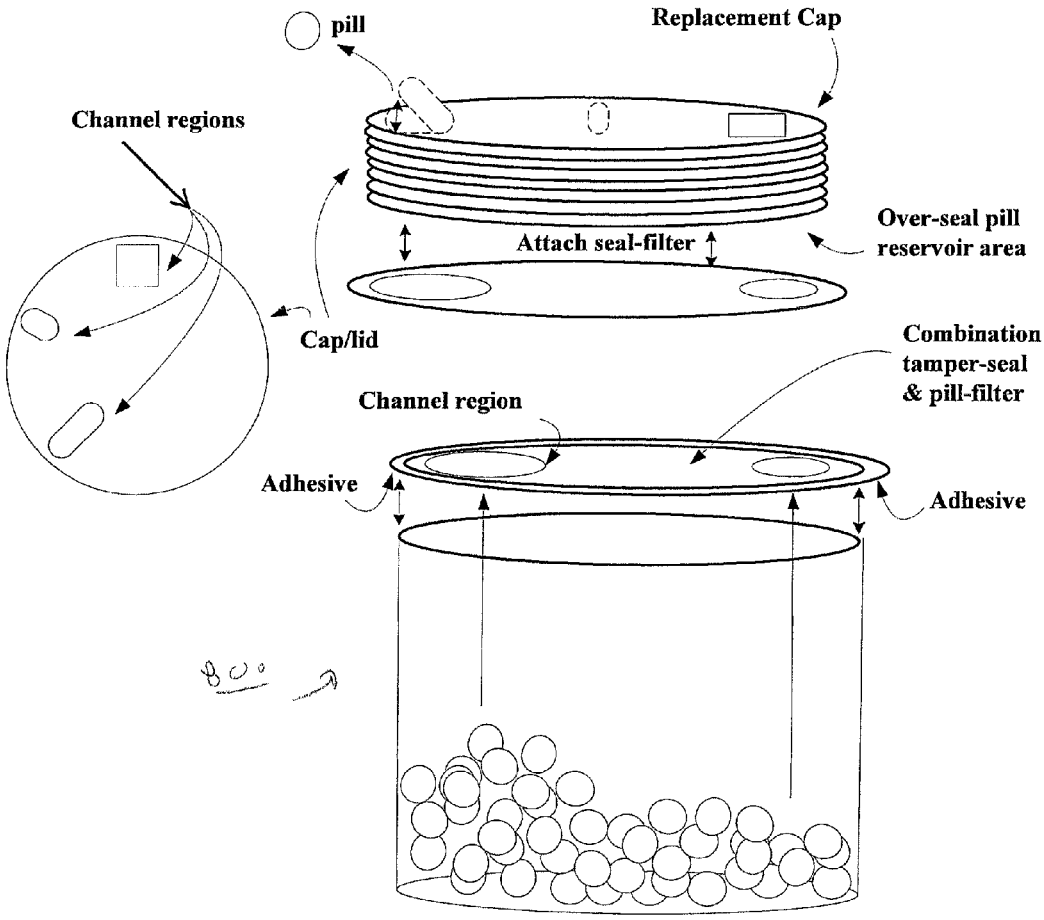
FIG. 8 is a yet another diagram representing yet additional examples of embodiments directed to pill-filtering articles, also according to the present disclosure.

FIGS. 6, 7 and 8 provide additional diagrams respectively representing further examples of embodiments directed to pill-filtering articles, also according to the present disclosure. In FIG. 6, a removable cap/lid is shown with the pill filtering article of the present invention. The cap/lid is shown as having channel regions and apertures to permit filtering and dispensing of differing pill types (pills of differing size, shape and structure). Though three holes or apertures are displayed, other combinations are contemplated and consistent with the present disclosure. In FIG. 7, a combination tamper-seal and pill filter is also shown and discussed above. The tamper-seal and pill-filter contains one or more channel regions for pill dispensing, and is coated with an adhesive. The tamper-seal and pill-filter is affixed via the adhesive to the pill container.

FIG. 7 also displays the cap/lid as having an over-seal pill reservoir area. In FIG. 8, a replacement cap is additionally provided. The replacement cap also contains an over-seal pill reservoir area and one or more channel regions for pill apertures of different pill types.

In yet other specific embodiments, such pill-filtering articles are sold as kits for installation by consumers (including patients) of these and other types of containers. The pill-filtering articles can be manufactured in different sizes (thickness and/or diameters) with different channel regions for different types of pills. The pill-filtering articles can also be manufactured with edge (optionally perforated) for a step of trimming to fit, in a custom manner, the containers in which the articles are to be used.

In connection with any of the above-discussed embodiments, it will be appreciated that the described features can be used in various combinations or alone, and that such features are associated with various aspects of methods contemplated in connection with the present disclosure. Such methods are described above and/or are covered by the appended claims.

The various embodiments described above are provided by way of illustration only and should not be construed to limit the invention. Based on the above discussion and illustrations, those skilled in the art will readily recognize that various modifications and changes may be made to the present disclosure without strictly following the exemplary embodiments and applications illustrated and described herein. Such modifications and changes do not depart from the true spirit and scope of the present invention.

What is claimed is:

1. An apparatus, comprising:

a pill-storage container;

a pill-filtering article configured and arranged to facilitate securing the pill-filtering article inside the pill-storage container near an inner wall thereof and below an upper surface of the pill-storage container, the pill-filtering article being configured and arranged to include a first portion corresponding to a channel-defining region for passing one pill at a time, and a second portion corresponding to a region of the pill-filtering article other than the channel-defining region, wherein the channel-defining region is configured for being secured within the pill-storage container and arranged to facilitate passage of pills through a formed aperture, thereby defining an aperture boundary through the channel-defining region for permitting passage of the pills one pill at a time based on at least one of pill size and pill shape, the pill-filtering article and the first portion, that corresponds to the channel-defining region, being configured and arranged to, after the formed aperture is provided via the channel-defining region, to pass the pills sequentially through the channel-defining region based on at least one of pill size and pill shape, and the pill-filtering article and the second portion of the pill-filtering article being configured and arranged to, after the formed aperture is provided via the channel-defining region, block the pills.

2. The apparatus of claim 1, wherein the upper surface is configured and arranged to secure to or against a container cap.

3. The apparatus of claim 1, wherein the channel-defining region has a thickness dimension for defining the aperture boundary at a non-orthogonal angle, relative to a plane along the upper surface, to facilitate an accumulation of pills at the bottom side of the aperture.

4. The apparatus of claim 1, wherein the pill-filtering article includes another channel-defining region.

5. The apparatus of claim 1, wherein the channel-defining region is configured and arranged as a tamper-indicating seal, and wherein the modification causes the seal to break wherefrom the aperture is formed.

6. A method, comprising the steps of:

providing the pill-storage container and the pill-filtering article of the apparatus of claim 1; and positioning the pill-filtering article inside the pill-storage container.

7. The method of claim 6, further including the step of placing pills in the pill-storage container.

8. The method of claim 7, further including the step of securing the pill-filtering article inside the pill-storage container near the inner wall of the pill-storage container and above the pills located therein.

9. The method of claim 8, wherein the step of securing the pill-filtering article inside the pill-storage container includes configuring and arranging the pill-filtering article with the channel-defining region closed and with the pill-filtering article configured and arranged to provide a tamper-indicating seal.

10. The method of claim 9, further including the step of forming the aperture by modifying the aperture boundary and thereby breaking the tamper-indicating seal.

11. The method of claim 10, further including the step of passing pills, one at a time, through the formed aperture, while the second portion of the pill-filtering article blocks.

12. The method of claim 11, wherein the aperture, formed in the pill-filtering article, is defined by the channel-defining region to provide a passageway that is sized according to a pill size of the pills placed in the pill-storage container.

13. The method of claim 6, further including the steps of:

securing the pill-filtering article inside the pill-storage container near the inner wall of the pill-storage container and above the pills located therein, and with the pill-filtering article configured and arranged to provide a tamper-indicating seal, and forming the aperture by modifying the aperture boundary and thereby breaking the tamper-indicating seal.

14. A method for dispensing a single pill at a time from a pill-storage container having a pill-filtering article configured and arranged to be secured inside the pill-storage container below an upper surface of the pill-storage container at which a container cap is located, the method comprising:

providing the pill-filtering article with a first portion corresponding to a channel-defining region for passing one pill at a time, a second portion corresponding to a region of the pill-filtering article other than the channel-defining region, and an aperture boundary in the channel-defining region, the aperture boundary being configured and arranged for permitting passage of the pills, such that the channel-defining region defines an aperture through the pill-filtering article and one pill at a time passes based on at least one of pill size and pill shape, whereby the pill-filtering article facilitates passage of the pills through the aperture while the second portion blocks the pills.

15. The method of claim 14, further including the step of providing the aperture through the pill-filtering article.

16. The method of claim 15, wherein the step of providing the aperture through the pill-filtering article is performed by pushing or punching out the boundary.

17. The method of claim 16, wherein the step of pushing or punching out the boundary is performed by a medicinal professional.

18. The method of claim 14, wherein the channel-defining region is configured and arranged as a tamper-indicating seal.

* * * * *